United States Patent [19]

Anderson et al.

[11] 3,959,684

[45] May 25, 1976

[54] MINIATURE LAMP CONSTRUCTION AND METHOD OF MANUFACTURE

[75] Inventors: John R. Anderson, Chesterland, Ohio; Steve Boros, Memphis, Tenn.

[73] Assignee: General Electric Company, Schenectady, N.Y.

[22] Filed: Jan. 2, 1975

[21] Appl. No.: 537,898

[52] U.S. Cl. ..... 313/318; 29/25.13; 313/315; 339/144 R; 339/145 R

[51] Int. Cl.[2] ..... H01J 5/48; H01J 5/50

[58] Field of Search ..... 313/318, 315; 29/25.13; 339/144 R, 145 R

[56] References Cited

UNITED STATES PATENTS

| | | | |
|---|---|---|---|
| 3,253,179 | 5/1966 | Edwards et al. | 313/318 |
| 3,445,720 | 5/1969 | Horan | 313/318 X |
| 3,784,867 | 1/1974 | Dupree | 313/318 |

*Primary Examiner*—Saxfield Chatmon, Jr.
*Attorney, Agent, or Firm*—John F. McDevitt; Lawrence R. Kempton; Frank L. Neuhauser

[57] ABSTRACT

An improved miniature size electric lamp is disclosed wherein an outer wire lead of the lamp is flattened and adhesively bonded to the inside rim of the base shell with an electrically-conducting basing cement. A method of manufacture for said lamp construction is also disclosed wherein the flattened section of the wire lead is aligned to lie in a plane approximately tangent to the envelope wall of the lamp prior to positioning the lamp envelope for assembly to the base shell. A layer of electrically-conducting basing cement is located around the periphery of the base shell to provide improved electrical contact between the side wire lead and the base shell. An insulating cement is applied to the remaining eyelet contacting wire lead at the glass to metal junction and extends a sufficient distance along the lead to electrically insulate this wire lead from the electrically conducting cement. The particular lamp construction further can utilize an electrically insulating basing cement to adhesively bond the lamp envelope to the base shell having the same resin binder as employed in the electrically-conducting basing cement so that both cements can be heat-cured simultaneously during a single operation in conventional automatic lamp manufacturing equipment.

10 Claims, 2 Drawing Figures

MINIATURE LAMP CONSTRUCTION AND METHOD OF MANUFACTURE

BACKGROUND OF THE INVENTION

This invention relates, in general, to the manufacture of miniature size electric lamps which can be carried out simply and reliably with available automatic lamp manufacturing equipment. More particularly, the present invention deals with improved means to provide an electrical termination between the side-lead wire of a miniature lamp construction and the inner-surface of the metal lamp base.

Certain types of miniature size electric incandescent lamps, such as that commercially designated as the No. 387 sub-miniature lamp, are in general use at present for indicator and instrument lighting applications. Such lamps are customarily comprised of a tubular glass lamp bulb or envelope of very small size, eg, around 7/32 inch diameter, on one end which is mounted, axially of the bulb, a lamp base in the form of a metal shell of slightly larger diameter than that of the bulb and inflanged at its closed end so that the lamp can be inserted and pushed bulb end first into a lamp socket in an instrument or other socket-supporting panel. The bulb contains a filament connected across a pair of current lead-in wires which are hermetically sealed through the side wall of the bulb at the neck end thereof by a conventional butt-type seal. The seal or neck end of the bulb extends into an open end of and is secured to the base shell by a customary ring of lamp basing cement which is peripherally disposed in the ring around the inside wall of the base shell below the rim, and the wire leads are electrically connected to the metal shell and eyelet contact, respectively, of the lamp base. The open inner end of the base shell into which the bulb extends is formed with an inwardly rolled or inturned curved lip within which the bulb is snugly received to center it in place more or less axially of the base shell.

The earliest manner of electrically connecting the side wire lead of an electrical lamp to the base shell was to position the wire lead so as to extend out between the wall of the lamp bulb and the rim of the base shell when the base was placed in mounting position on the neck end of the bulb, and to then solder the wire lead to the outer side of the base shell adjacent its rim. Such procedure, however, resulted in a formation of a small mound or accumulation of the solder used for connection on the outer side of the base shell and protruding therefrom. For the intended usage of the particular sub-miniature indicator type lamps referred to above designed for bulb end first slide-in insertion of the lamp into the lamp socket, such protruding solder accumulations on the base shells would not be permissible since they would, in effect, block the endwise sliding insertion movement of the lamp into its socket. Accordingly, some other way of basing these type lamps had to be developed which would avoid the presence of any solder protrusions on the base shells.

To this end, the basing procedure now in customary use comprises the steps of forming the base shell with an apertured inward indent or recess in its side wall near the closed outer end of the base through the aperture of which indent the side wire lead is threaded and cut off flush with the outer side of the base shell, after which the cut-off wire lead is then soldered to the base shell within the indent therein. With this modified basing procedure, the solder accumulation at the wire-to-base shell solder connection is concealed entirely within the indent in the base shell and thus does not protrude from the outer side thereof. However, because of the necessity for threading the side wire lead through the side aperture in the base shell, such a modified basing procedure precludes the use of conventional type automatic base threading mechanisms similar to that disclosed in U.S. Pat. No. 2,120,877 — Uber, for example, which are customarily employed in the lamp making art, because of the substantial cost saving realized therefrom, to automatically feed and position lamp bases in mounting position on the glass bulbs of electric lamps, with the end or center contact wire lead of the lamp bulb extending through the customary end contact eyelet of the base in position for soldering thereto. In their customary manner of operation, these automatic base-threading mechanisms lower the bases down over and guide the upstanding center contact wire lead, extending endwise from the lamp bulb, into and upwardly through the opening in the end contact eyelet of the base. Obviously, the presence of a side wire lead extending laterally from the lamp bulb and required to be threaded into a side aperture in the base shell of the lamp, as in the case of the modified lamp basing procedure referred to above, would interfere with the lowering movement of the lamp base shell, by such automatic base-threading mmechanisms, down over the upstanding center wire lead of the lamp and into mounting position on the end of the lamp bulb.

It has more recently been discovered in the manufacture of the larger size electric lamps that the side lead can be soldered directly to the inside surface of the lamp base shell at its rim. In this newer method, a portion of the side lead is flattened after which a quantity of solder is coated on the flattened lead-in portion, a flux applied over the solder and then the lamp envelope forcibly inserted into the base shell which mechanically wedges the side lead between the shell and the bulb neck. After the lamp envelope has been assembled in this manner to the base shell, the rim of the base shell is heated to melt the solder coating on the wire lead section to form a solder connection thereof to the base shell. Such a method is not particularly adapted to the high speed lamp manufacturing machines presently employed for miniature lamp construction by reason of the physical interference which takes place between the protruding side lead and the base shell which would either cause misalignment of the members being assembled or remove solder from the side lead and produce a poor electrical termination.

Many types of basing cements are also known to join a metal base to the glass envelope of an electric lamp. The original basing cements were electrically non-conductive and comprised of an inert filler material, an insulating binder, and a processing agent or vehicle. The typical binders were organic polymers which included shellac, phenol-aldehyde resins, silicon resins, and epoxy resins. More recently, it has been learned that conductive particulates, generally in the form of finely-divided metal powders, could be admixed to an otherwise electrically-insulating cement in order to render the entire composition electrically-conductive for certain lamp applications. A known lamp construction comprises a hermetically sealed glass envelope from which a pair of lead-in wires protrude, wherein the lead-in wires are adhesively bonded to the glass envelope by a conductive epoxy cement to separate metal tangs forming the lamp's circuit with a resistant filament connected between the lead-in wires.

CROSS-REFERENCE TO RELATED APPLICATIONS

A newly discovered method of effecting electrical connection between the side lead wire and the inner-surface of the lamp base shell is disclosed in copending application, Ser. No. 197,662, filed Nov. 11, 1971, in the name of Steve Boros, which is entitled "METHOD OF BASING ELECTRICAL DEVICES", and which is now issued U.S. Pat. No. 3,785,020. In this method, the protruding end of the side lead is also flattened and coated with solder prior to insertion of the lamp envelope into the base shell. As distinct from the earlier discovered method of effecting an electrical connection between said flattened side lead and the inner-surface of the lamp base shell which have been reported above, the flattened wire lead section is further aligned prior to insertion of the lamp envelope into the base shell so that it lies in the plane approximately tangent to the envelope wall and thereby avoids interfering with placement of the lamp envelope in the base shell. Consequently, the lamp basing method, according to the copending application, readily lends itself to the use of available automatic lamp manufacturing equipment and which is substantially free of the problems caused by misalignment between the lamp envelope and base shell including poorly soldered electrical connection between the side lead and the base shell.

Another copending application which is also assigned to the assignee of the present invention describes and claims a basing cement of the dual-purpose type for bonding the side lead to the base shell in an electric lamp as well as bonding the lamp envelope to the base shell More particularly, in pending application Ser. No. 320,531, filed Jan. 2, 1973 in the name of Mary S. Jaffe and entitled "LAMP BASING CEMENT" which is now U.S. Pat. No. 3,876,559, there is disclosed a lamp basing cement composition having an adhesive binder which comprises the heat-cured product of a 1,2-butadiene prepolymer, a vinyl type crosslinker and a free-radical initiator. A particulate filler is also included in the cement which determines if the heat-cured product will be insulative or electrically conductive. Either type cement can be cured during high speed lamp manufacture to form the solid adhesive from a liquid suspension of the polymerization reactants which do not contain volatile solvents. By employing such common adhesive binder, it thereby becomes possible to employ a basing cement which is electrically-insulating from adhesively bonding the lamp envelope to the base shell while having a basing cement which is electrically-conducting for adhesively bonding the side lead to the base shell and to cure both basing cements simultaneously during high speed lamp manufacture in a single operation.

A still further copending application which is assigned to the same assignee describes and claims the same general lamp construction of the present invention wherein the side wire lead is adhesively bonded to the inner surface of the base shell with an electrically-conducting base cement utilizing a heat-cured organic polymer binder having a finely divided conductive solid dispersed therein. Said copending application Ser. No. 335,805 was filed Feb. 26, 1973 in the names of the present inventors and is entitled "MINIATURE LAMP CONSTRUCTION AND METHOD OF MANUFACTURE" which is now U.S. Pat. No. 3,873,175. In said lamp construction and method of manufacture, the electrically-conducting base cement is present only at a limited peripheral section of the base shell where physical contact with the side lead is made. Such localization of the electrically-conductive cement in this lamp construction can be achieved by coating the flattened section of said side-lead with cement prior to assembly of the lamp envelope with the base shell.

SUMMARY OF THE INVENTION

It is an important object of the invention, therefore, to provide an improved miniature size electric lamp construction having novel electrically connecting means to connect the side lead wire to the inside surface of the lamp base shell.

Another important object of the invention is to provide a novel miniature size electric lamp construction wherein a common adhesive binder is employed for an electrically-insulating cement to adhesively bond the lamp envelope with the base shell and for an electrically-conducting cement to adhesively bond the side lead to the inner rim of the base shell.

Still another important object of the invention is to provide a novel method of electrically connecting the side lead of an electric lamp to the metal base shell.

A still further object of the invention is to provide a novel method of basing an electric lamp wherein the lamp envelope and side lead are adhesively bonded to the inner-surface of the base shell in a single heating operation.

Briefly stated, the present miniature size electric lamp construction includes a tungsten filament connected between a pair of wire leads which are hermetically sealed within a glass envelope, with said wire leads extending outwardly from said envelope and being electrically connected to a metal base shell wherein a portion of the side lead element is flattened and extends between the envelope wall and the rim of the base shell so as to lie in a plane approximately tangent to the envelope wall and being wedged between the wall of said envelope and the rim of said base shell and with said flattened portion of the wire lead also being adhesively bonded to the inside rim of the base shell with an electrically-conducting basing cement. In one of its preferred embodiments, said novel lamp construction further includes having the glass envelope adhesively bonded to the inside wall of the base shell with an electrically-insulating basing cement utilizing the same adhesive bonding system employed in the electrically-conducting basing cement. In accordance with the general method of the present invention, the basing operation includes the step of flattening at least that section of the side lead which, in the final mounted position of the base on the lamp envelope end, will extend and intervene between the envelope wall and the rim of the base shell, the said flattening of said wire lead section being in a plane such that when the flattened section is in its said intervening position extending between the envelope wall and the rim of the base shell, it will lie in the plane approximately tangent to the envelope wall. Said general method further includes applying a coating of insulating cement to the remaining eyelet contacting lead wire at the lamp envelope metal to glass junction and extending along the length of the wire so as to electrically insulate it from the electrically-conducting cement. After applying a ring of electrically-conducting basing cement around the inside circumference at the rim end of the lamp base which overlies a previously applied ring of electrically insulating basing cement, the lamp base is positioned over the said end of the envelope with the said flattened wire lead section extending and wedged between the wall of said envelope and the rim of the metal shell of said base, and then the rim of the base shell is heated to heat-cure both cement rings and adhesively bond the side wire lead to the inner-base shell.

Further objects and advantages of the invention will appear from the following detailed description of preferred embodiments thereof and from the accompanying drawing.

DESCRIPTION OF THE PREFERRED EMBODIMENTS

Figure 1:
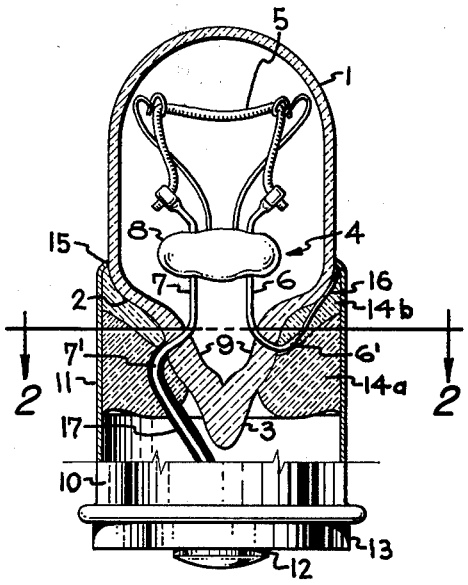
FIG. 1 is an elevational view showing the completed lamp construction having the side lead adhesively bonded to the inner-surface of the base shell rim, the insulated eyelet lead-in wire, and the lamp envelope adhesively bonded to the inside wall of the base shell below the rim.
Figure 2:
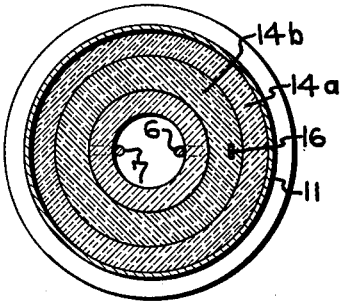
FIG. 2 is a cross-sectional view taken along the line 2—2 and showing the disposition of the individual basing cements in the lamp construction of FIG. 1.

Referring to the drawings, the invention is there illustrated as applied to the manufacture of a sub-miniature electric incandescent lamp such as that commerically designated as the No. 387 type lamp customarily used for indicator and instrument lighting purposes and comprising a sealed evacuated tubular glass bulb or envelope 1 of very small size, eg, around 7/32 inch diameter and ½ inch or so in length which is closed off at its neck end 2 by the residue of an exhaust tube tip 3. Sealed into the envelope 1 is a lamp mount 4 comprising a filament 5, which may be in the form of a coiled tungsten wire, connected at its ends across a pair of spaced metal wire leads or lead-in wires 6 and 7 which are bridged and held in spaced relation by a glass support bead 8 fusion sealed to the wires 6 and 7. As shown, the wire leads 6 and 7 are sealed through the side wall 9 of the envelope 1 at the neck end 2 thereof and at locations more or less diametrically opposite one another, by a conventional butt-type hermetic seal. A lamp base 10 comprising a metal shell 11 and a metal end contact eyelet 12 secured together by an insulator ring 13 is mounted on the neck end 2 of the envelope 1. The neck end 2 of the envelope 1 extends into the open end of, and is secured in place to the base shell 11 by a customary ring **14*a* of an electrically-insulating lamp basing cement, and a ring 14*b* of electrically-conducting cement used to secure the side lead wire termination to the base shell. As shown, the base shell 11 is of slightly larger diameter, that is, around one thirty-second inch or so larger diameter, than the outside diameter of the tubular glass envelope or bulb 1 so as to permit bulb end first insertion of the lamp into a lamp socket. The open inner end of the base shell 11 into which the envelope 1 extends is formed with an inwardly rolled or inturned curved lip or rim 15 within which the envelope 1 is snugly received to center it in place more or less axially of the base shell. One of the wire leads, eg, wire lead 6, herein referred to as the side lead, is electrically connected to the base shell 11 by adhesively bonding it thereto with a ring of an electrically conducting type basing cement, while the other or center eyelet contacting wire lead 7 is insulated and soldered to the center or end contact eyelet 12 of the lamp base 10.**

A particularly useful dual-purpose type basing cement which can be employed in the above described lamp construction is disclosed in the aforementioned pending application, Ser. No. 320,531. As therein disclosed, a basing cement composition utilizing as the adhesive binder the heat-cured product of a 1,2-butadiene prepolymer, a vinyl type crosslinker and a free-radical initiator can be employed which in one form provides an electrically non-conducting adhesive, but which can also be modified to provide an electrically-conducting adhesive for use in the lamp construction. Said in a different way, such basing cement composition provides a means of adhesively bonding one or more of the lead-in wires of the lamp along with the lamp glass envelope to the metal base shell to effect either electrical isolation between the bonded lead-in wire or the lamp envelope with the base or to provide electrical connection therebetween. The alternative forms of these basing cements are compatible for lamp manufacture in that both can be employed for a single lamp construction without significant intermixing which could occasion shortcircuiting between the individual lead-in wires. Both forms of such type basing cement can be heat-cured simultaneously utilizing the same heating condition of heating in air for approximately 20 seconds at around 240°C which takes place during the automatic lamp manufacture. When an insulative type filler is admixed with the above specified liquid binder system, a heat-cured product is obtained which provides electrical isolation and useful insulative fillers include titanium dioxide pigment and finely divided white glass and which are non-alkaline so as not to inhibit heat-curing of the prelimirization system. When an electrically-conductive type filler is selected such as finely divided metal solids and the like, then a heat-cured product is obtained which conducts electrically so that a lead-in wire bonded with such cememt would also be electrically connected to the metal base shell of the lamp. A typical composition for such type basing cements comprises 50–90 parts of a 1,2-butadiene prepolymer, 5–25 parts of a vinyl crosslinker, and 1–4 parts of a free-radical initiator which further contains 200–300 parts of the filler. A particularly useful composition for the electrically-conducting form of such basing cement utilizes as the conductive filler glass microspheres coated with a conductive metal along with metal particulates containing up to 10 percent by weight of said coated microspheres of finely divided conductive metal solids.

In mounting the base 10 on the lamp envelope 1 in the above described lamp embodiment and electrically connecting the side lead 6 to the metal shell 11 of the base in the manner according to the invention, the outer end portion 6′ of the lead wire 6 extending outwardly of the enveoope wall 9 from its seal thereto is first formed on the lamp manufacturing equipment so as to extend in a substantially straight direction laterally outward from the envelope 1. The outer end portion 7′ of the other or center contact wire lead 7 is also preferably formed to extend in a substantially straight direction laterally outward from the envelope 1 and angled toward the tip end 3 thereto. At least a section 16 of the outer side lead portion 6′ adjacent its point of emergence from the lamp envelope 1 and which, in the final mounted position of the base 10 on the envelope end 2 will extend and intervene between the envelope wall and the rim 15 of the base shell 11, is then flattened in a place transverse to the axis of the envelope 1, by compressing it between a pair of opposed jaws on the lamp manufacturing equipment so that when the outer lead portion 6' is bent to extend alongside the side wall of the envelope toward the end thereof opposite its neck end 2, the flattened section 16 will lie flatwise against and tangent to the envelope side wall. The remaining lead wire is then provided with a coating of electrically insulating basing cement as previously described which is heat-cured prior to positioning the lamp base shell in its mounting position over said end of the lamp envelope for the assembly therebetween. In this manner of assembly between the lamp envelope and the base shell, there will be no physical interference between the members thereafter being assembled. The base 10 is thereafter placed in mounting position on the neck end 2 of the glass envelope 1, and said members are then moved axially together and positioned relative to one another to locate the base in its mounting position on the neck end 2 of the envelope. When the base shell 11 is thus assembled in its mounting position with said lamp envelope 1, there is also present a ring 14*a* of the electrically-insulating type basing cement as above described which is peripherilly disposed below the rim 15 of the base shell as shown in FIG. 1.

While the envelope 1 and the base 10 are thus supported in their assembled position with the base end 10 positioned up, the rim 15 of the base shell 11 is suitably heated, as by means of gas fires directed thereagainst, to heat-cure the electrically-conducting basing cement on the flattened wire lead portion 16 and adhesively bond said portion between the base shell rim and the envelope side wall so as to effect electrical connection of said side lead to the base shell as shown in FIG. 1. The heating of the base shell to form said connection also simultaneously acts to cure the ring 14*a* of the electrically insulating basing cement on the inside wall of the base shell so as to cause it to adhesively bond the side wall of the glass envelope in place on the neck end 2 of the envelope. With the electrical connection of the side lead 6 to the base shell 11 and the securing of the base 10 to the glass envelope 1 thus effected, the lamp basing operation can then be completed by rimming any excess portion of the side wire lead and exposed beyond the rim 15 of the base shell 11, as by breaking it off at the rim of the base shell, then trimming off the excess portion of the end contact wire lead 7' exposed beyond the end contact eyelet 12 of the base 10 after said wire lead 7 has been soldered to the eyelet in a manner customary in a lamp-manufacturing art.

In a preferred method of manufacture according to the present invention, the side lead 6 is flattened and bent as above described while the remaining eyelet contacting lead 7 is aligned for physical engagement with the contact eyelet 12 prior to positioning the lamp base shell in its mounting position over the end of said envelope. A liquid coating of electrically insulating cement 17 is also applied to said aligned section of the eyelet contacting lead and heat-cured before positioning the lamp base shell and envelope for mounting. As still further preliminary steps to assembling the base shell and envelope as an integral unit, a liquid ring of electrically insulating cement 14*a* and an overlying liquid ring of electrically-conductive cement 14*b* are applied as liquid coatings around the inside periphery of the base shell. After applying the cement in this manner to the respective lamp parts and positioning the lamp base shell in its mounting position over the envelope so that the flattened wire lead section extends and wedges between the wall of said envelope and the rim of the metal shell, the rim portion of said shell is heated to heat-cure both rings of cement.

It will be apparent to those skilled in the art from the foregoing description that a novel lamp construction has been disclosed along with a novel method of obtaining said lamp construction. It will also be appreciated that various changes can be made in said lamp construction and method without departing from the spirit and scope of the invention. For example, it is contemplated that said lamp construction and method could further include additional means of pretreating the side lead member prior to adhesive bonding to the base shell, such as by cleaning or by electrical plating and electrically-conducting coating thereon to improve the electrical connection and thereby further advance the objectives of the invention. Likewise, such a pretreated side lead could also be incorporated without further modification of the method herein disclosed. It is therefore intended to limit the present invention only by the scope of the following claims.

What we claim is new and desire to secure by Letters Patent of the United States is:

1. In a miniature size electric lamp having a tungsten filament connected between a pair of wire leads, which are hermetically sealed within a tubular shaped glass envelope, with said wire leads extending outwardly from said envelope and being electrically connected to a cylindrical metal base shell having an inturned rim, the improvement which comprises having one flattened wire lead extending between the envelope wall and the rim of the base shell so as to lie in a plane approximately tangent to the envelope wall and being disposed between the wall of said envelope and the rim of said base shell, said wire lead being adhesively bonded to the inside rim of the base shell with an electrically-conducting base cement utilizing a heat-cured organic polymer binder having a finely divided conductive solid dispersed therein, and the remaining lead being partially coated with electrical insulation to prevent electrical shorting with the electrically-conducting cement.

2. An electric lamp as in claim 1 which further includes having the glass envelope adhesively bonded to the inside wall of the base shell with an electrically-insulation basing cement.

3. An electric lamp as in claim 2 wherein the electrically-insulating basing cement is peripherally disposed in a ring around the inside wall of the base shell below the rim and the electrically-conducting basing cement overlies the electrically-insulating basing cement as a ring around the inside rim of the base shell.

4. An electric lamp as in claim 1 wherein the lead wire insulation coating comprises the heat-cured product of a 1,2-butadiene prepolymer, a vinyl crosslinker and a free-radical initiator which further contains a filler of conductive metal particulates.

5. An electric lamp as in claim 4 wherein the conductive metal particulates comprise glass microspheres coated with a conductive metal.

6. An electric lamp as in claim 2 wherein the electrically-insulating basing cement comprises the heat-cured product of a 1,2-butadiene prepolymer, a vinyl type crosslinker, and a free-radical initiator.

7. An electric lamp as in claim 6 which further contains a filler of electrically-insulating particulates.

8. The method of electrically connecting the cylindrical metal shell having an inturned rim of a lamp base to be mounted on an end of a tubular shaped glass envelope of an electric lamp to a pair of wire leads extending outardly from the said envelope end, which method comprises the steps of flattening at least that section of one wire lead which, in the final mounted position of the base on the said envelope end, will extend and intervene between the envelope wall and the rim of the base shell, the said flattening of said wire lead section being in a plane such that when the flattened section is in its said intervening position extending between the envelope wall and the rim of the base shell, it will lie in a place approximately tangent to the envelope wall, applying a coating of electrical insulation to a portion of the other wire lead, applying a ring of electrically insulating cement around the inside wall of the base shell below the rim, applying a ring of electrically-conducting base cement overlying the electrically insulating cement at the inside rim of said base shell to the flattened wire lead section, positioning the lamp base in its said mounting position over the said end of the envelope with the said flattened wire lead section extending and wedged between the wall of said envelope and the rim of the metal shell of said base, and then heating the rim of the base shell to heat-cure the applied cements and adhesively bond the flattened wire lead to the base shell.

9. The method of claim 8 which further includes the steps of positioning the electrically insulated wire lead for physical engagement with a contact eyelet of the base shell and heat-curing the electrical insulation prior to positioning the lamp base shell in its mounting position over the said end of the said envelope.

10. The method of claim 9 wherein the positioning of the flattened wire lead is accomplished by initially aligning said wire lead in a straight direction laterally outward from the said envelope, flattening that section of the said laterally extending wire lead in a plane transverse to the axis of said envelope, applying a coating of an electrically-conducting basing cement to the said flattened wire lead section and bending the portion of said outer wire lead adjacent to its point of emergence from the envelope, and including at least a portion of its said flattened section, to extend alongside the outer wall of said envelope in a direction toward the other end thereof, with the plane of the bent flattened wire lead portion disposed tangent to the envelope wall.

* * * * *